US008743017B2

(12) United States Patent
Toujo

(10) Patent No.: US 8,743,017 B2
(45) Date of Patent: Jun. 3, 2014

(54) METAMATERIAL AND METHOD FOR MANUFACTURING SAME

(75) Inventor: Atsushi Toujo, Nagaokakyo (JP)

(73) Assignee: Murata Manufacturing Co., Ltd., Nagaokakyo-Shi, Kyoto-Fu (JP)

( * ) Notice: Subject to any disclaimer, the term of this patent is extended or adjusted under 35 U.S.C. 154(b) by 417 days.

(21) Appl. No.: 13/033,657

(22) Filed: Feb. 24, 2011

(65) Prior Publication Data

US 2011/0139488 A1 Jun. 16, 2011

Related U.S. Application Data

(63) Continuation of application No. PCT/JP2009/064908, filed on Aug. 27, 2009.

(30) Foreign Application Priority Data

Sep. 3, 2008 (JP) ..... 2008-225896

(51) Int. Cl.
*H01Q 15/02* (2006.01)

(52) U.S. Cl.
USPC ..... 343/909; 343/700 MS; 428/222

(58) Field of Classification Search
USPC ..... 343/700 MS, 909; 174/126.1; 428/222; 264/272.19
See application file for complete search history.

(56) References Cited

U.S. PATENT DOCUMENTS 7,538,946 B2 5/2009 Smith
7,696,951 B2 * 4/2010 Sanada ..... 343/909
7,821,473 B2 * 10/2010 Justice et al. ..... 343/909
7,940,228 B1 * 5/2011 Buckley ..... 343/810
2009/0040131 A1 * 2/2009 Mosallaei ..... 343/911 R
2013/0108856 A1 * 5/2013 Liu et al. ..... 428/222

FOREIGN PATENT DOCUMENTS

JP 2008-507733 T 3/2008

OTHER PUBLICATIONS

Pendry et al. "Low Frequency Plasmons in thin wire structures" J. Phys. Condens. Matter vol. 10 (1998) pp. 4785-4809.

Tojo et al. "Potential for Matamaterial with Chip Coil" 2008 IEICE Electronics Society, Collection of Papers for Lectures 1, Sep. 2, 2008, p. 58, C-22-33.

"Left-handed Metamaterial", Nikkei Electronics Jan. 2, Nikkei Business Publications. Inc. Jan. 2, 2006, pp. 75-81.

PCT/JP2009/064908 Written Opinion dated Nov. 11, 2009.

Japanese Office Action issued for corresponding application JP 2010-527762 date of dispatch May 14, 2013 (Englsih translation attached).

* cited by examiner

*Primary Examiner* — Tho G Phan
(74) *Attorney, Agent, or Firm* — Dickstein Shapiro LLP

(57) ABSTRACT

A metamaterial that includes a metallic wire and a supporting member. The metallic wire has a length of substantially half the wavelength of electromagnetic waves, and is coiled in the shape of a spring. The supporting member fixes the metallic wire such that the central axis of the metallic wire is parallel in direction to an electric field generated between a signal line through which an electric current flows and a ground. The metallic wire placed in such manner resonates with electromagnetic waves having a wavelength approximately twice as long as the metallic wire, and exhibits a negative dielectric constant.

45 Claims, 16 Drawing Sheets

METAMATERIAL AND METHOD FOR MANUFACTURING SAME

CROSS REFERENCE TO RELATED APPLICATIONS

The present application is a continuation of International Application No. PCT/JP2009/064908, filed Aug. 27, 2009, which claims priority to Japanese Patent Application No. JP2008-225896, filed Sep. 3, 2008, the entire contents of each of these applications being incorporated herein by reference in their entirety.

FIELD OF THE INVENTION

The present invention relates to a metamaterial, and more particularly, relates to a left-handed metamaterial with a negative dielectric constant and a negative magnetic permeability.

BACKGROUND OF THE INVENTION

In recent years, devices referred to as metamaterials have been attracting attention. This metamaterial refers to an artificial substance which has electromagnetic and/or optical properties provided by none of substances in nature. Typical properties of this metamaterial include a negative magnetic permeability ($\mu<0$), a negative dielectric constant ($\in<0$), or a negative refractive index (when the magnetic permeability and the dielectric constant are both negative). It is to be noted that the region with $\mu<0$ and $\in>0$ or the region with $\mu>0$ and $\in<0$ is also referred to as a "evanescent solution region", whereas the region with $\mu<0$ and $\in<0$ is also referred to as a "left-handed region".

It is common that the left-handed metamaterial with $\mu<0$ and $\in<0$ is created by the combination of a substance with a negative dielectric constant $\in$ with a substance with a negative magnetic permeability $\mu$.

As a means for achieving a negative magnetic permeability $\mu$, a split ring resonator (SRR) can be used (for example, see Non-Patent Document 1)

On the other hand, as a means for achieving a negative dielectric constant $\in$, a metal rod can be used. In a mainstream method for achieving a negative dielectric constant $\in$, a metal rod which has an infinite (that is, sufficiently large with respect to the wavelength of electromagnetic waves) length is used to decrease the plasma frequency. Non-Patent document discloses an array of metal thin wires which allows for the achievement of a negative dielectric constant $\in$. In addition, Patent Document 1 (Japanese Patent Application Laid-Open No. 2008-507733) discloses a wire in a periodic lattice for a negative dielectric constant.

In contrast, it has been also known that a metal rod which has a finite length generates a negative dielectric constant. When a metal rod which has a length of half the wavelength $\lambda$ of electromagnetic waves is resonated with the electromagnetic waves, a negative dielectric constant is generated.

Patent Document 1: Japanese Patent Application Laid-Open No. 2008-507733

Non-Patent document 1: "Left-handed Metamaterial", Nikkei Electronics January 2, Nikkei Business Publications, Inc., Jan. 2, 2006, PP. 75-81

Non-Patent document 2: J B Pendry et al., "Low Frequency Plasmons in thin-wire structures", J. Phys. Condens. Matter Vol. 10 (1998) 4785-4809

SUMMARY OF THE INVENTION

The metamaterial which achieves a negative dielectric constant with the use of a metal rod sufficiently longer than the wavelength is too large in size for the application to electronic components. In addition, even in the case of the method using a metal rod of $\lambda/2$, it is difficult to reduce the metamaterial in size. For example, in order to create a metamaterial for developing a negative dielectric constant at 3 GHz, a metal rod of 50 mm is required. The metamaterial in this size is too large for use in electronic components.

The present invention has been achieved to solve the problems described above, and an object of the present invention is to provide a small-size metamaterial.

In accordance with an aspect of the present invention, a metamaterial is provided which exhibits a negative dielectric constant at a predetermined wavelength. The metamaterial includes a metallic wire coiled in the shape of a spring, which has a length of substantially half the predetermined wavelength, and a supporting member for fixing the position of the metallic wire. The supporting member fixes the position of the metallic wire so that the central axis of the metallic wire is parallel to the direction of an electric field generated around the metallic wire.

In accordance with another aspect of the present invention, a metamaterial is provided which exhibits a negative dielectric constant at a predetermined wavelength. The metamaterial includes a metallic wire coiled in the shape of a spring, which has a length of substantially half the predetermined wavelength, a conductor through which an electric current flows, a ground for serving as a reference potential, and a supporting member placed between the conductor and the ground for fixing the position of the metallic wire. The supporting member fixes the position of the metallic wire so that the central axis of the metallic wire is parallel to the direction of an electric field between the conductor and the ground.

In accordance with yet another aspect of the present invention, a metamaterial is provided which exhibits a negative dielectric constant at a predetermined wavelength. The metamaterial includes a plurality of metallic wires coiled in the shape of a spring, each of which has a length of substantially half the predetermined wavelength, a conductor through which an electric current flows, a ground for serving as a reference potential, and a supporting member placed between the conductor and the ground for fixing the positions of the plurality of metallic wires. The supporting member fixes the positions of the metallic wires so that the central axis of each of the metallic wires is parallel to the direction of an electric field between the conductor and the ground.

In accordance with yet another aspect of the present invention, a metamaterial is provided which exhibits a negative magnetic permeability at a predetermined wavelength. The metamaterial includes a metallic wire coiled in the shape of a spring, which has a length of substantially half the predetermined wavelength, and a supporting member for fixing the position of the metallic wire. The supporting member fixes the position of the metallic wire so that the central axis of the metallic wire is parallel to the direction of a magnetic field generated around the metallic wire.

In accordance with yet another aspect of the present invention, a metamaterial is provided which exhibits a negative magnetic permeability at a predetermined wavelength. The metamaterial includes a metallic wire coiled in the shape of a spring, which has a length of substantially half the predetermined wavelength, a conductor through which an electric current flows, a ground for serving as a reference potential, and a supporting member placed between the conductor and the ground for fixing the position of the metallic wire. The supporting member fixes the position of the metallic wire so that the central axis of the metallic wire is parallel to the direction of a magnetic field generated by the electric current.

In accordance with yet another aspect of the present invention, a metamaterial is provided which exhibits a negative magnetic permeability at a predetermined wavelength. The metamaterial includes a plurality of metallic wires coiled in the shape of a spring, each of which has a length of substantially half the predetermined wavelength, a conductor through which an electric current flows, a ground for serving as a reference potential, and a supporting member placed between the conductor and the ground for fixing the positions of the plurality of metallic wires. The supporting member fixes the positions of the plurality of metallic wires so that the central axis of each of the metallic wires is parallel to the direction of a magnetic field generated by the electric current.

In accordance with yet another aspect of the present invention, a metamaterial is provided which exhibits a negative dielectric constant and a negative magnetic permeability at a predetermined wavelength. The metamaterial includes a metallic wire coiled in the shape of a spring, which has a length of substantially half the predetermined wavelength, a conductor through which an electric current flows, a ground for serving as a reference potential, and a supporting member placed between the conductor and the ground for fixing a position of the metallic wire. The supporting member fixes the metallic wire so that the direction of the central axis of the metallic wire is nonorthogonal to the direction of an electric field generated by the electric current and the direction of the central axis is nonorthogonal to the direction of a magnetic field generated by the electric current.

In accordance with yet another aspect of the present invention, a metamaterial is provided which exhibits a negative dielectric constant and a negative magnetic permeability at a predetermined wavelength. The metamaterial includes a plurality of metallic wires coiled in the shape of a spring, each of which has a length of substantially half the predetermined wavelength, a conductor through which an electric current flows, a ground for serving as a reference potential, and a supporting member placed between the conductor and the ground for fixing the positions of the plurality of metallic wires. The supporting member fixes the plurality of metallic wires so that the central axis direction of each of the metallic wires is nonorthogonal to the direction of an electric field generated by the electric current and nonorthogonal to the direction of a magnetic field generated by the electric current.

Preferably, the supporting member fixes the plurality of metallic wires in irregular directions.

More preferably, each of the metallic wires has an insulating film.

Preferably, the metallic wires are coiled so as to follow a spherical surface.

Preferably, the metallic wires have a smaller pitch at either end thereof than in a central portion thereof.

Preferably, the metallic wires have a larger pitch at either end thereof than in a central portion thereof.

Preferably, the metamaterial further includes a conductive plate connected to an end of the metallic wire.

In accordance with yet another aspect of the present invention, a method for manufacturing a metamaterial is provided for manufacturing a metamaterial which exhibits a negative dielectric constant and a negative magnetic permeability at a predetermined wavelength. The manufacturing step includes a step of preparing a plurality of metallic wires coiled in the shape of a spring, each of which has a length of substantially half the predetermined wavelength, a step of placing the plurality of metallic wires in a fluid medium in a random manner, and a step of solidifying the medium in which the plurality of metallic wires is placed.

Preferably, each metallic wire has an insulating film.

Preferably, each metallic wire is coiled so as to follow a spherical surface.

According to the present invention, the metallic wire for use in the metamaterial has a length of substantially half the wavelength of an electromagnetic wave, and is coiled in the shape of a spring. Therefore, according to the present invention, a small-size metamaterial can be achieved.

DETAILED DESCRIPTION OF THE INVENTION

First Embodiment

Figure 1:
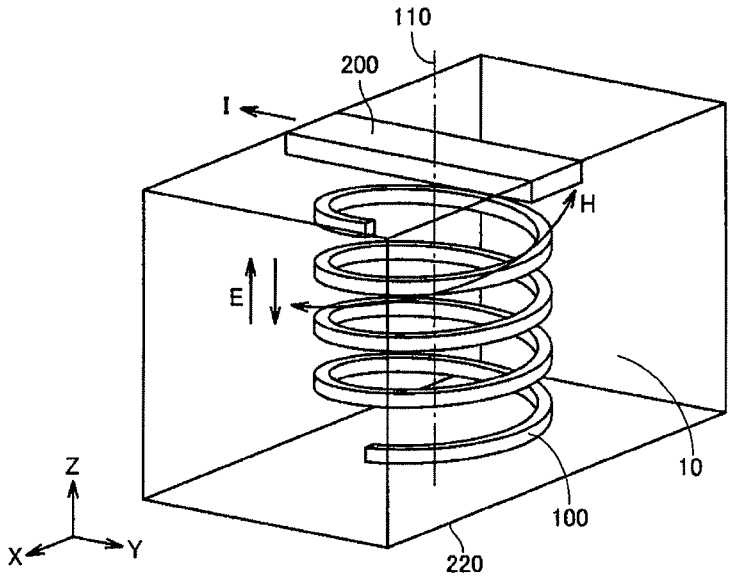
FIG. 1 is a diagram for explaining the configuration of a metamaterial according to a first embodiment.

The configuration of a metamaterial according to the first embodiment will be described with reference to FIG. 1. FIG. 1 is a diagram for explaining the configuration of a metamaterial according to the first embodiment.

The metamaterial according to the first embodiment includes a metallic wire 100 and an outer covering 10. The metallic wire 100 is covered with the outer covering 10 which is a nonmagnetic body. The metallic wire 100 is placed between a signal line 200 and a ground 220. The ground 220 serves as a reference potential.

An electric current 1 containing a predetermined frequency component flows through the signal line 200. In the present embodiment, the signal line 200 is supposed to be a strip line. However, the signal line 200 is an example of a conductor through which an electric current flows, and the form of the conductor is not to be considered limited to the strip line.

The total length of the wire rod of the metallic wire 100 is set to on the order of a half the wavelength of an electric current flowing through the 200. In this case, the electric current flowing through the signal line 200 is supposed to have a frequency in the GHz band, whereas the metallic wire 100 has a length of 13 mm.

In addition, the metallic wire 100 is coiled around a central axis 110. More specifically, the metallic wire 100 has the shape of spring. However, the shape of the metallic wire is not limited to the shape shown in FIG. 1, which is coiled so as to follow a cylindrical surface. For example, the metallic wire 100 may have a shape curling along a square pillar. It is to be noted that modification examples of the shape of the metallic wire will also be described later.

The metallic wire 100 may have a length and a shape as described above. As the metallic wire 100, coils of coiled metallic wires can be used. As the metallic wire 100, commercially available metallic wires (for example, commercially available coils) may be used, or specially made metallic wires may be used. Alternatively, the metallic wire 100 is not limited to any metallic wires, and may be conductor lines formed by a printing method or the like (this configuration will be described later).

The outer covering 10 fixes the position of the metallic wire 100. Resin materials such as Teflon (registered trademark) are suitable as the outer covering 10. However, the outer covering 10 is an example of the supporting member for fixing the position of the metallic wire 100, and the metallic wire 100 may be fixed by other member.

The metallic wire 100 is not electrically connected to the signal line 200 or the ground 220, and has a floating state fixed by the outer covering 10 which is a supporting member.

The central axis 110 of the metallic wire 100 is parallel to an electric field E generated by an electric current flowing through the signal line 200, more particularly, an electric field E generated between the signal line 200 and the ground 220. More specifically, the outer covering 10 fixes the metallic wire 100 so that the central axis 110 is parallel to the electric field. In other words, the metallic wire 100 is placed so that a difference in electric potential is produced across the ends of the metallic wire in accordance with the gradient of the electric field.

In the example shown in FIG. 1, the central axis 110 extends in a direction from the signal line 200 toward the ground 220. More specifically, the central axis 110 is orthogonal to the ground 220 plane, and penetrating through the signal line 200. This arrangement makes the central axis 110 parallel to an electric field created by the electric current flowing through the signal line 200 (perpendicular to a magnetic field H created by the electric current flowing through the signal line 200).

With respect to the signal line 200, the coiled resonator 100 gives rise to a resonance in response to a specific frequency (resonant frequency) component in the electric field generated by the electric current flowing through the signal line 200.

Figure 2:
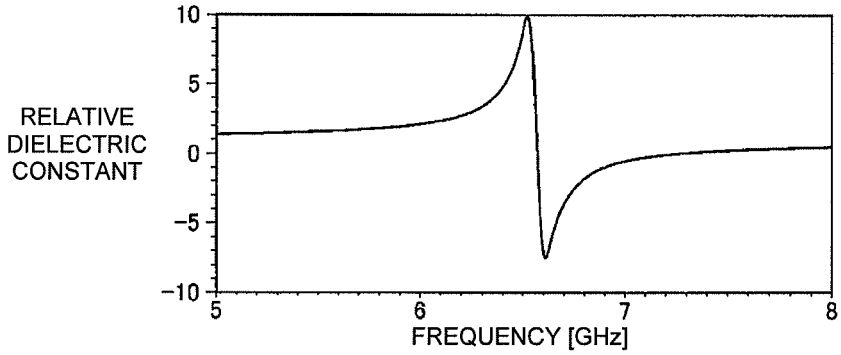
FIG. 2 is a diagram showing the relative dielectric constant of the metallic wire shown in FIG. 1.
Figure 3:
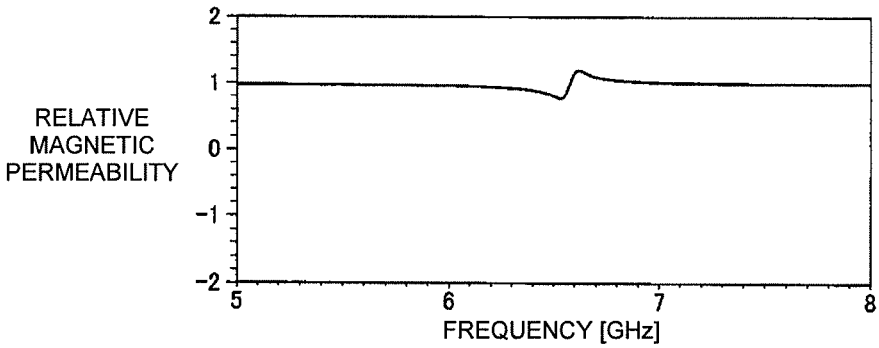
FIG. 3 is a diagram showing the relative magnetic permeability of the metallic wire shown in FIG. 1.

With reference to FIGS. 2 and 3, electromagnetic characteristics of the metallic wire 100 will be described. FIG. 2 is a diagram showing the relative magnetic permeability of the metallic wire 100 shown in FIG. 1. In addition, FIG. 3 is a diagram showing the relative dielectric constant of the metallic wire 100 shown in FIG. 1. The relative dielectric constant used herein represents the ratio of a dielectric constant to a vacuum dielectric constant, whereas the relative magnetic permeability represents the ratio of a magnetic permeability to a vacuum magnetic permeability. As shown in FIG. 2, the metallic wire 100 exhibits a negative dielectric constant around 6.6 GHz. On the other hand, the magnetic permeability of the metallic wire 100 constantly takes a positive value although the magnetic permeability varies around 6.6 GHz.

As described above, it is determined that the coiled metallic wire which is ½ the wavelength in length develops a negative dielectric constant. Thus, the metamaterial of the present embodiment can be reduced in size as compared with a metamaterial which develops a negative dielectric constant with use of a linear metallic wire.

It is to be noted that the frequency at which a negative dielectric constant is generated is not completely consistent with ½ of the total length in the case of the metallic wire 100 coiled in the shape of a spring, and has a slight deviation from ½ of the total length because of the coiling of the metallic wire 100.

Figure 4:
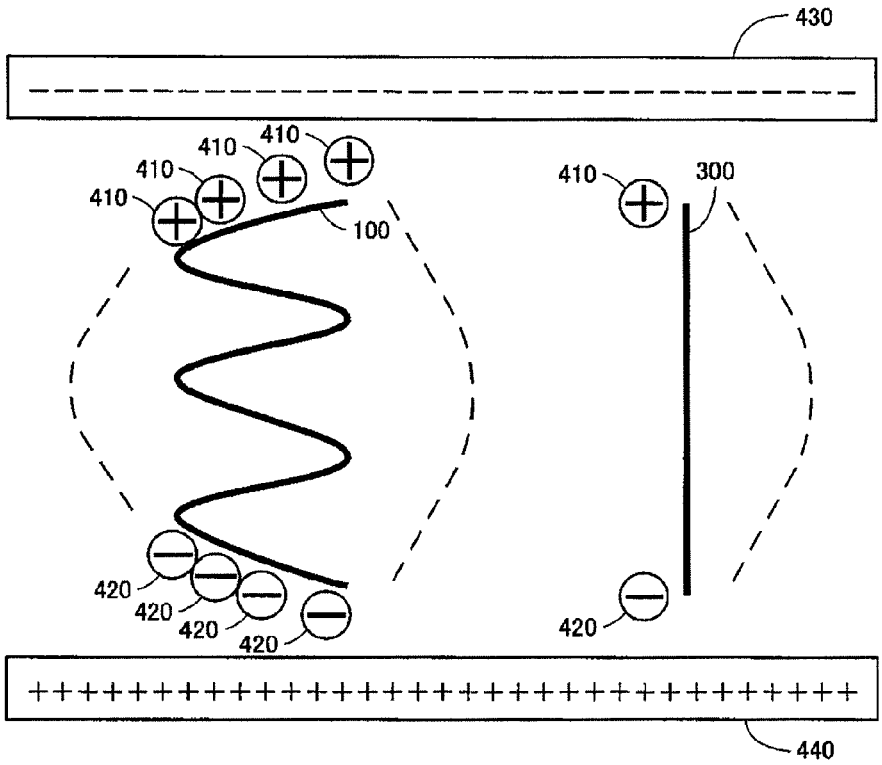
FIG. 4 is a diagram for explaining a difference between a metallic wire coiled in the shape of a spring and a linear metallic wire.

This deviation will be described with reference to FIG. 4. FIG. 4 is a diagram for explaining a difference between a metallic wire 100 coiled in the shape of a spring and a linear metallic wire 300. The metallic wire 100 and the metallic wire 300 are placed between a negative charge region 430 in which negative charges are present and a positive charge region 440 in which positive charges are present. The central axis of the metallic wire 100 and the linear metallic wire 300 are each parallel to the direction of an electric field generated between the negative charge region 430 and the positive charge region 440.

The placement as described above creates differences in electric potential across the ends of the metallic wire 100 and of the metallic wire 300. Among the ends of the metallic wire 100 and of the metallic wire 300, the ends facing the negative charge region 430 have positive charges 410 accumulated. In addition, among the ends of the metallic wire 100 and of the metallic wire 300, the ends facing the positive charge region 440 have negative charges 420 accumulated.

As can be seen from FIG. 4, the positive and negative charges are accumulated only on the tips in the case of the linear metallic wire 300, and the metallic wire 300 thus resonates at a frequency depending on the line length. On the other hand, in the case of the metallic wire 100 in the shape of a spring, the regions in which the positive and negative charges are accumulated not only include the tips, but also are somewhat extensive from the tips of the metallic wire 100 as shown in FIG. 4. For this reason, the resonant substantial length of the metallic wire 100 is reduced to increase the frequency. It is to be noted that the resonance 100 of the metallic wire in the shape of a spring is a combination of varying degrees of resonances, rather than created only at a frequency corresponding to the shortest distance between the positive and negative charges.

The designer should design the length of the metallic wire 100 in consideration of the properties described above, so as to be substantially ½ the resonant wavelength corresponding to a resonant frequency at which a negative dielectric constant is desired. For the design, for example, the designer may search a metallic wire with an appropriate resonant frequency by carrying out a simulation or an experiment for several metallic wires which have a length on the order of a half of the resonant wavelength.

Figure 5:
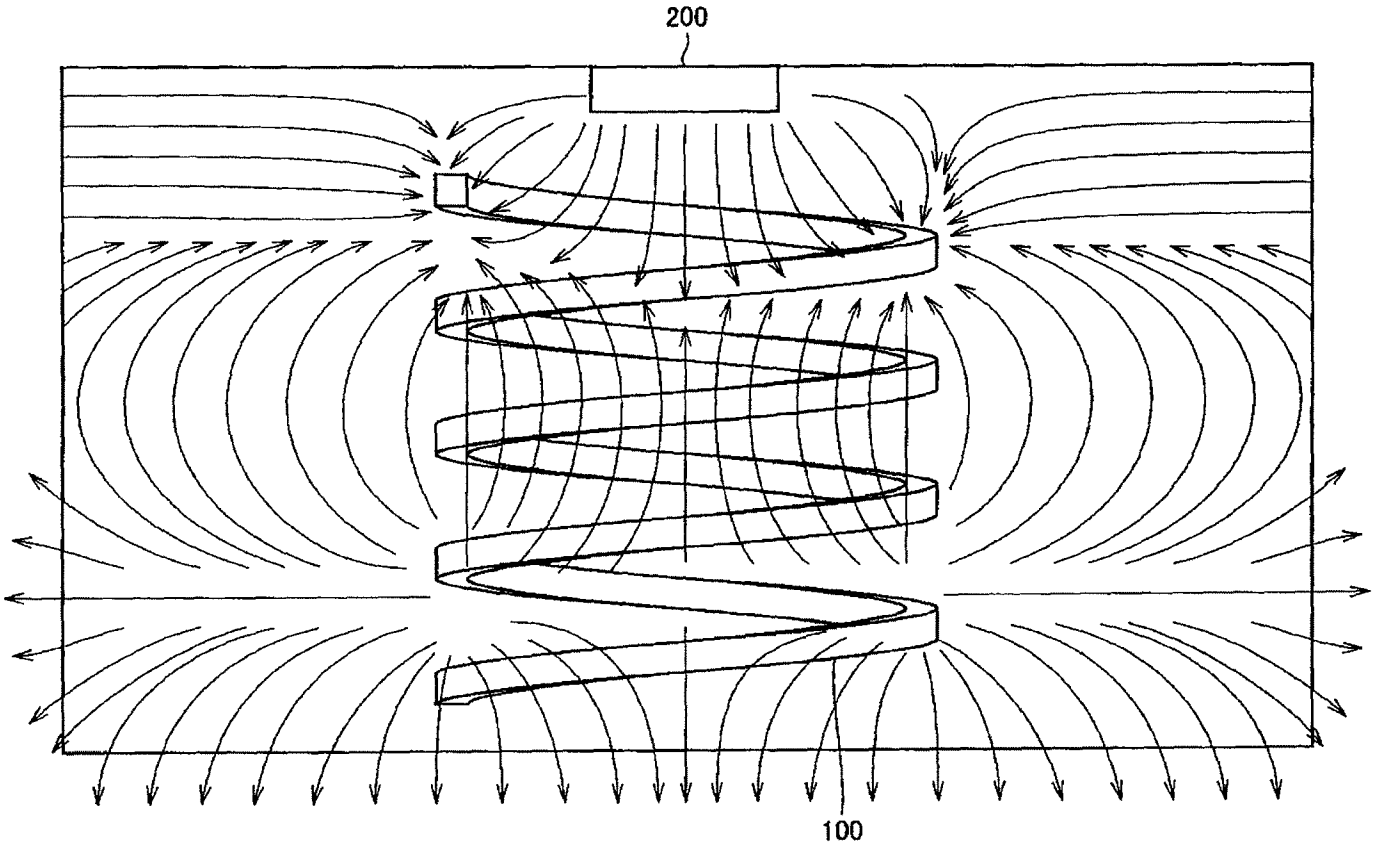
FIG. 5 is a diagram schematically illustrating an electric field distribution in a space including a metallic wire and a signal line.

FIG. 5 schematically illustrates an electric field distribution in a space including a metallic wire 100 and a signal line 200. FIG. 5 is a diagram simply illustrating a field analysis result in the condition in which an electric field flows through the signal line 200 to apply an electric field from the bottom toward the top in FIG. 5.

As can be seen with reference to FIG. 5, a downward electric field is generated from the signal line 200 at the upper end of the metallic wire 100, whereas a downward electric field is generated toward the ground at the lower end of the metallic wire 100, and it is determined that the metallic wire 100 exhibits a negative dielectric constant. For the discussion of the positive or negative dielectric constant, the electric field vectors have importance around the signal line 200 and the ground, while the electric field vector has less importance in the central portion of the metallic wire 100.

In addition, as can be seen from the principle described above, a desired resonant frequency is obtained by changing the length of the metallic wire 100 in the case of the metamaterial according to the present embodiment. A specific example thereof will be described with reference to FIGS. 6 to 8.

Figure 6:
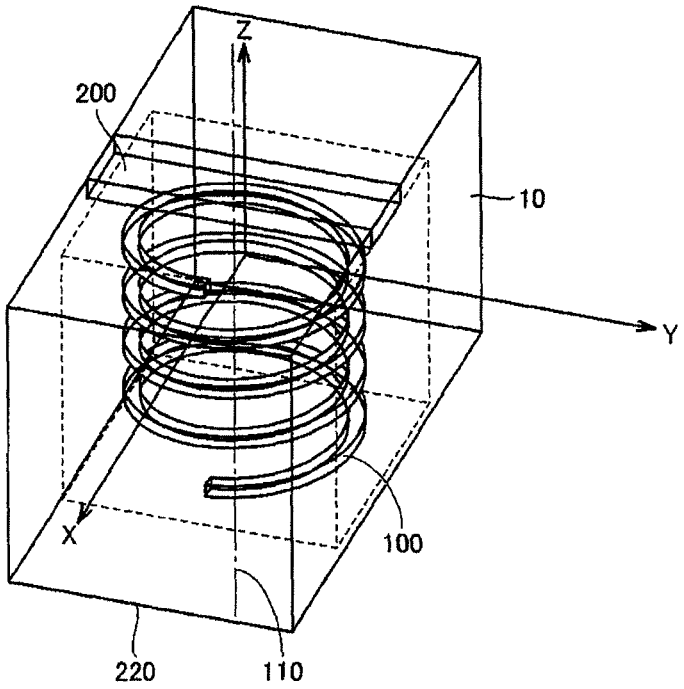
FIG. 6 is a diagram illustrating a metamaterial according to the first embodiment, which uses a metallic wire different in length from FIG. 1.

FIG. 6 is a diagram illustrating a metallic wire 100 placed so that the central axis 110 of the metallic wire 100 is parallel to an electric field as in the case of FIG. 1. However, unlike the case of FIG. 1, the metallic wire 100 is supposed to have a length of 28 mm.

Figure 7:
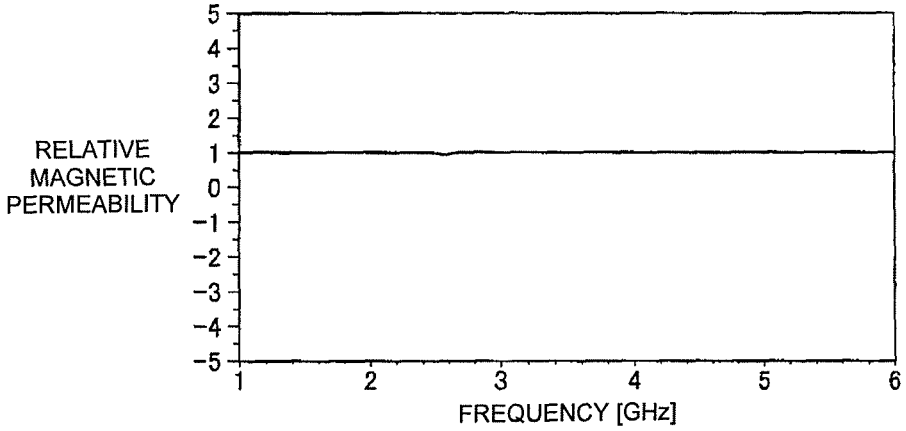
FIG. 7 is a diagram showing the relative magnetic permeability of the metallic wire shown in FIG. 6.
Figure 8:
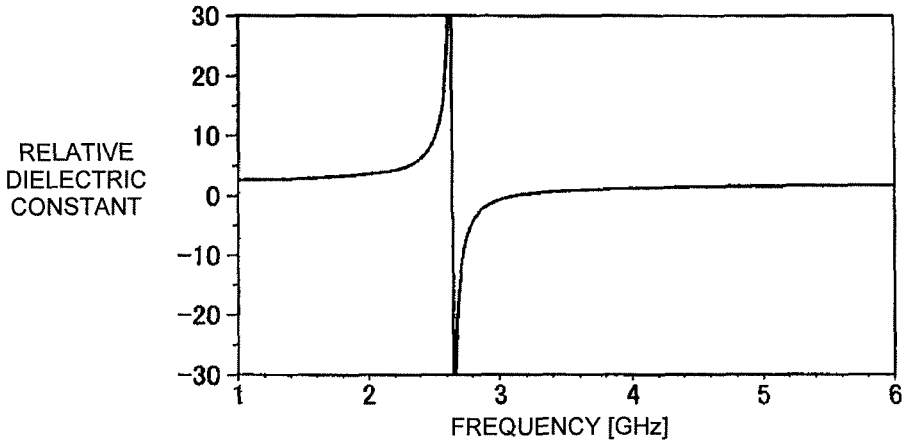
FIG. 8 is a diagram showing the relative dielectric constant of the metallic wire shown in FIG. 6.

The relative magnetic permeability and relative dielectric constant exhibited by the metamaterial shown in FIG. 6 are respectively shown in FIGS. 7 and 8. As shown in FIG. 8, the metamaterial in FIG. 6 exhibits a negative dielectric constant around 2.6 GHz. On the other hand, the magnetic permeability is constantly positive as shown in FIG. 7.

The metamaterial with one metallic wire 100 placed in the outer covering 10 has been described above. However, a metamaterial may be created which includes a plurality of metallic wires 100 and a supporting member for fixing the plurality of metallic wires 100. In this case, the supporting member fixes each metallic wire 100 in a direction parallel to an electric field. The use of the plurality of metallic wires 100 can achieve a metamaterial which develops a negative dielectric constant in over a wider range.

In order to provide uniform characteristics in an extensive space to a certain degree, the supporting member preferably fixes each metallic wire 100 in a periodic position. For example, the supporting member may fix the respective metallic wires 100 at regular intervals one-dimensionally along the signal line 200. Alternatively, the supporting member may periodically fix the respective metallic wires 100 at regular intervals two-dimensionally in a plane with the central axis 110 in the normal direction. The metallic wire 100 coiled allows the thickness of the metallic wire 100 in the direction of the central axis 110 to be reduced, thereby allowing a thin planar metamaterial to be achieved.

Second Embodiment

In the first embodiment, an example has been described in which the metallic wire 100 in the shape of a spring is used to achieve a metamaterial with a negative dielectric constant (∈). In the second embodiment, an example will be described in which a metallic wire in the shape of a spring is used to achieve a metamaterial with a negative magnetic permeability (μ).

The metamaterial according to the second embodiment refers to a metallic wire 100 which has the same length and shape as those of the metallic wire 100 shown in FIG. 6, which is placed so that the central axis 110 of the metallic wire 1000 is parallel to a magnetic field (perpendicular to an electric field created by an electric field flowing through a signal line 200).

The fact that the metallic wire 100 placed as described above indicates a negative magnetic permeability will be described below with reference to FIGS. 9 through 10.

Figure 9:
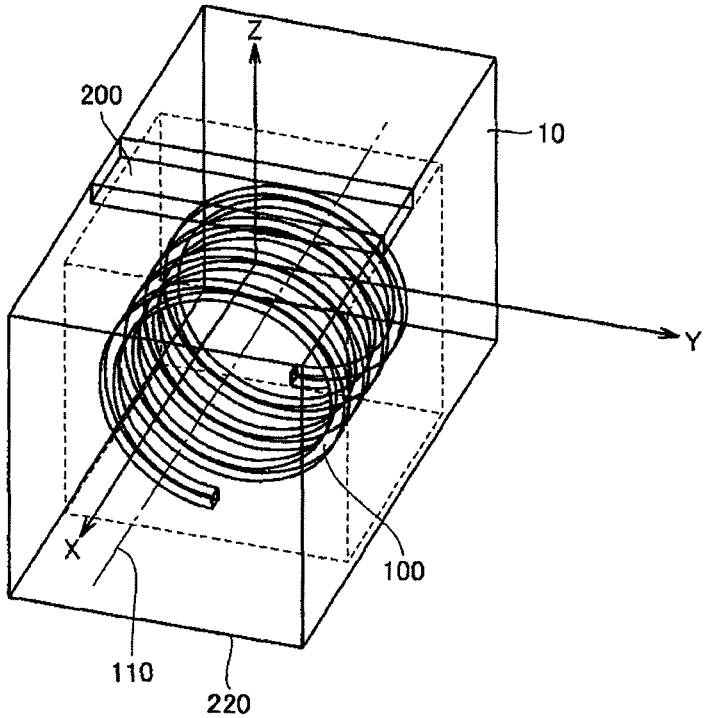
FIG. 9 is a diagram for explaining the configuration of a metamaterial according to a second embodiment.

FIG. 9 is a diagram for explaining the configuration of a metamaterial according to the second embodiment. As shown in FIG. 9, the metamaterial according to the second embodiment is obtained by rotating the metallic wire 100 shown in FIG. 6 around the Y axis by 90 degrees to be placed so that the central axis of the metallic wire 100 is parallel to a magnetic field generated by an electric field flowing through a signal line 200.

Figure 10:
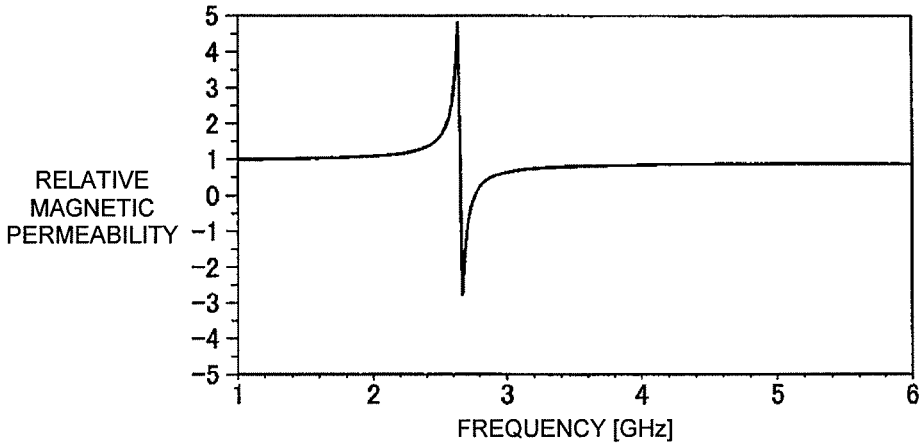
FIG. 10 is a diagram showing the relative magnetic permeability of the metamaterial shown in FIG. 9.
Figure 11:
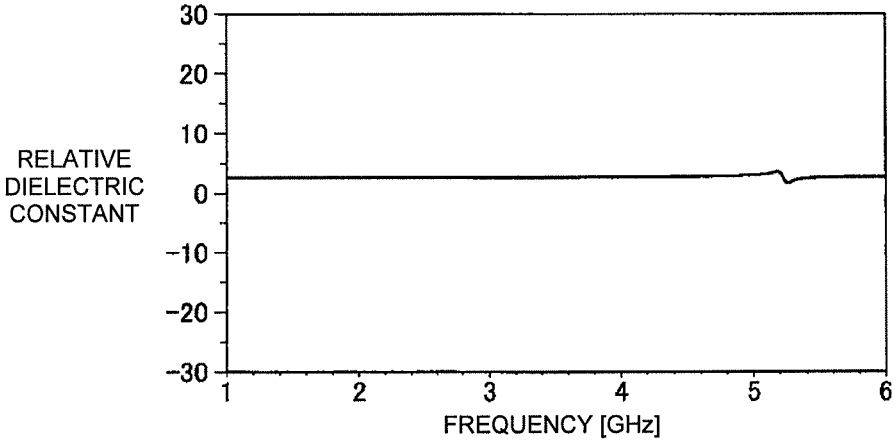
FIG. 11 is a diagram showing the relative dielectric constant of the metamaterial shown in FIG. 9.

The relative magnetic permeability and relative dielectric constant exhibited by the metamaterial shown in FIG. 9 are respectively shown in FIGS. 10 and 11. As shown in FIG. 10, the metamaterial in FIG. 9 exhibits a negative magnetic permeability around 2.6 GHz. On the other hand, as shown in FIG. 11, the dielectric constant is constantly positive.

It is determined that the central axis changed in direction as described above causes the metallic wire 100 which has the same structure to both exhibit a negative dielectric constant in some cases and exhibits a negative magnetic permeability in some cases.

It is to be noted that a metamaterial may be created which includes a plurality of metallic wires 100 and a supporting member for fixing the plurality of metallic wires 100 as in the case of the first embodiment.

Third Embodiment

The metallic wire 100 described in the first embodiment or the second embodiment can achieve a negative dielectric constant and a negative magnetic permeability at the same time, depending on the angles to the electric field and the magnetic field. Such a metamaterial will be described in the third embodiment.

Figure 12:
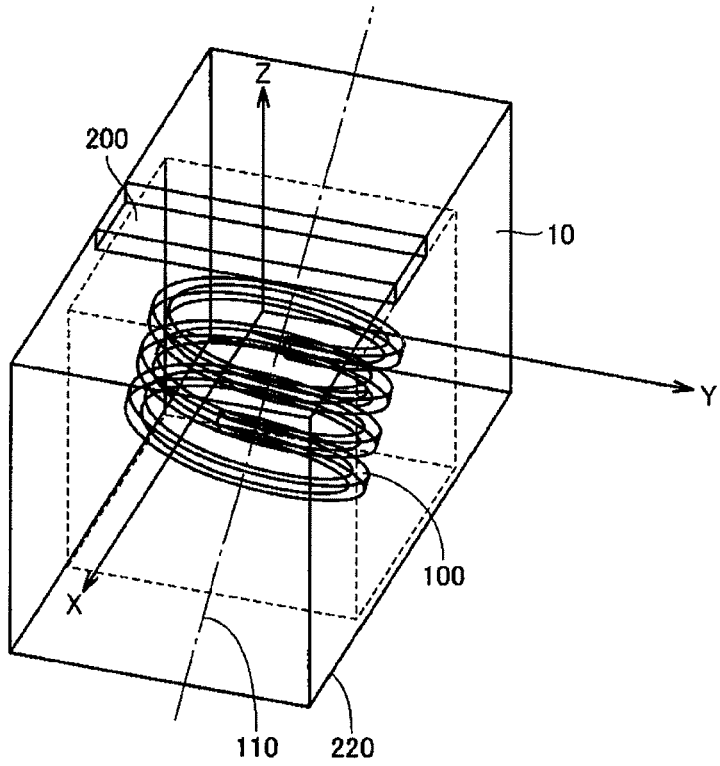
FIG. 12 is a diagram for explaining the configuration of a metamaterial according to a third embodiment.

FIG. 12 is a diagram for explaining the configuration of a metamaterial according to the third embodiment. As shown in FIG. 12, the metamaterial according to the third embodiment is placed through the rotation of the metallic wire 100 shown in FIG. 6 (with its central axis oriented in the Z direction) around the Y axis by 52 degrees.

Figure 13:
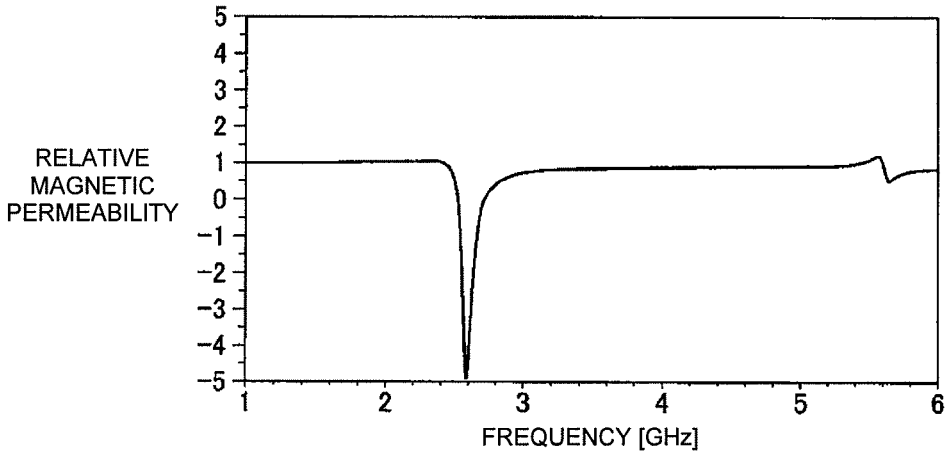
FIG. 13 is a diagram showing the relative magnetic permeability of the metamaterial shown in FIG. 12.
Figure 14:
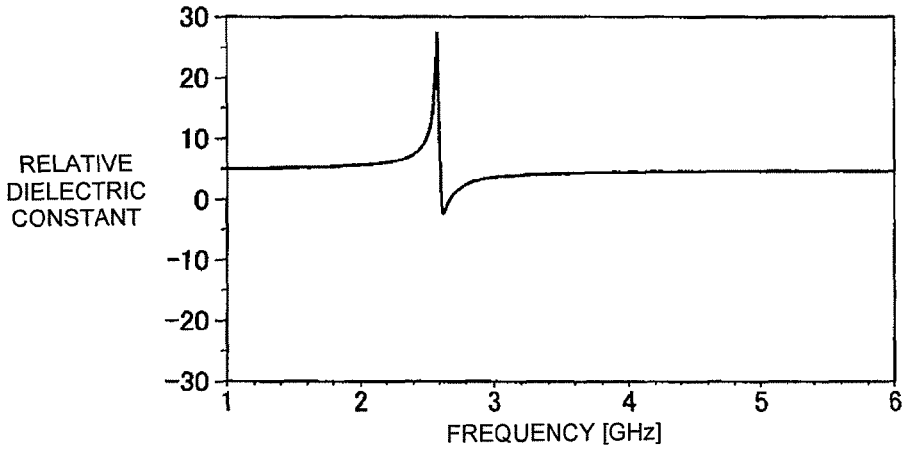
FIG. 14 is a diagram showing the relative dielectric constant of the metamaterial shown in FIG. 12.

The relative magnetic permeability and relative dielectric constant exhibited by the metamaterial shown in FIG. 12 are respectively shown in FIGS. 13 and 14. As shown in FIG. 13, the metamaterial in FIG. 12 exhibits a negative magnetic permeability around 2.6 GHz. In addition, as shown in FIG. 14, the metamaterial in FIG. 12 exhibits a negative dielectric constant around 2.6 GHz.

It is to be noted that the arrangement for achieving a negative dielectric constant and a negative magnetic permeability at the same time is not to be considered limited to the arrangement shown in FIG. 12. In general, as long as the central axis direction of the metallic wire 100 is nonorthogonal to the electric field direction (the Z direction in FIG. 12) and the magnetic field direction (the X direction in FIG. 12), the metallic wire 100 develops a negative dielectric constant and a negative magnetic permeability at the same time.

However, in order to develop both a negative dielectric constant and a negative magnetic permeability efficiently, the central axis is preferably placed in a plane spreading in the electric field direction and the magnetic field direction as shown in FIG. 12.

It is to be noted that the angle made by the central axis and the magnetic field direction for allowing both the negative dielectric constant and the negative magnetic permeability to have their best values is not necessarily 45 degrees. Depending on the total length and shape of the coil, an angle which is not 45 degrees provides better results. In the case of the coil shown in FIG. 12, the best results are obtained at on the order of 52 degrees.

The angle for obtaining the best results may be determined by the designer of the metamaterial, based on the result of a simulation, an experiment, etc. However, in order to achieve a practical negative dielectric constant and a negative magnetic permeability at the same time, it is believed that the angle of the central axis with respect to the magnetic field is desirably set to on the order of 30 to 70 degrees. When the direction of the central axis is brought too much close to the electric field direction or the magnetic field direction, no sufficient negative magnetic permeability or dielectric constant will become able to be obtained.

It is to be noted that as in the case of the first embodiment and the second embodiment, a metamaterial may be created which includes a plurality of metallic wires 100 and a supporting member. In this case, the central axes of the respective metallic wires 100 may have a direction in common or may have random directions. The former metamaterial with the central axes of the respective metallic wires 100 in a common direction has an orientation. More specifically, the electromagnetic field and metamaterial are limited in direction for generating a negative dielectric constant and magnetic permeability. The latter metamaterial with the central axes of the respective metallic wires 100 in random directions has no orientation. In addition, the latter metamaterial has the advantage of being manufactured easily. The latter metamaterial will be described in detail in an eighth embodiment.

Fourth Embodiment

While the metamaterials using the cylindrical metallic wire 100 have been described in the first to third embodiments described above, the shape of the metallic wire 100 is not limited to a cylindrical shape.

Figure 15:
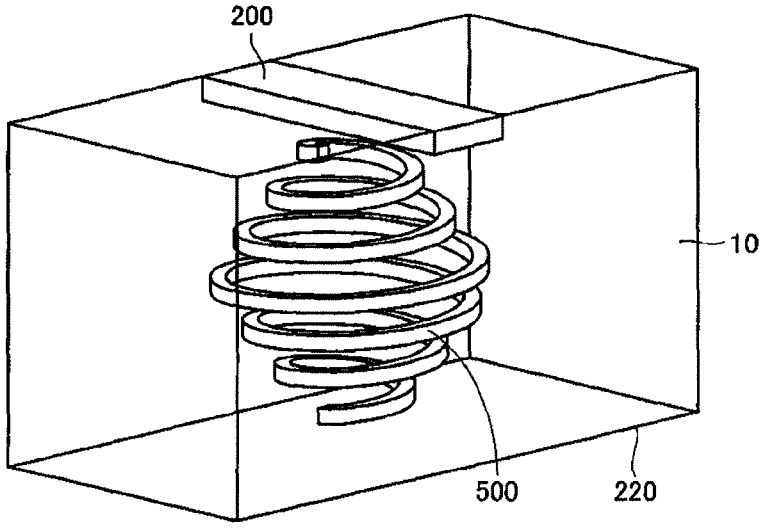
FIG. 15 is a diagram for explaining the configuration of a metamaterial according to a fourth embodiment.

For example, a spherical metallic wire 500 coiled along a spherical surface to have a bulging central portion as shown in FIG. 15 can be used in place of the metallic wire 100. It is to be noted that while an example is shown in FIG. 15 in which the metallic wire 100 in the first embodiment is replaced by the metallic wire 500, it will be understood that the metallic wires 100 in the second embodiment and the third embodiment can be replaced by the metallic wire 500. In particular, the use of the metallic wire 500 in the third embodiment has the advantage that the size of the metamaterial is unchanged no matter how the metallic wire 500 is tilted.

Fifth Embodiment

The metallic wires 100 described in the respective embodiments above are coiled at a constant pitch. However, it is also possible to use a metallic wire at a nonuniform pitch. In the fifth embodiment and a sixth embodiment described later, a metamaterial using a metallic wire at a nonuniform pitch will be given as an example.

Figure 16:
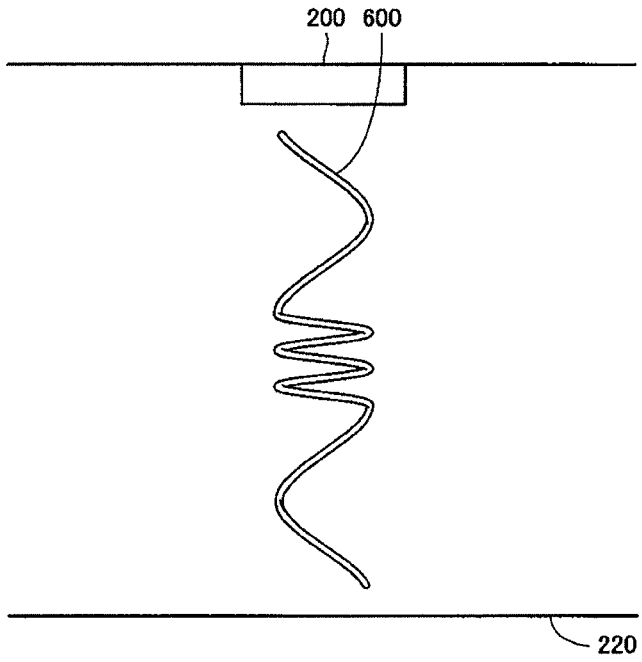
FIG. 16 is a diagram for explaining the configuration of a metamaterial according to a fifth embodiment.

A metamaterial according to the fifth embodiment will be described with reference to FIG. 16. FIG. 16 is a diagram for explaining the configuration of a metamaterial according to the fifth embodiment.

As shown in FIG. 16, a metallic wire 600 coiled in the shape of a spring is used in the fifth embodiment, which has a smaller pitch in a central portion thereof than at either end thereof. More specifically, the metal is coiled more in the central portion in the case of the metallic wire 600. In the present embodiment, the metallic wire 600 is supposed to have a total length of 15 mm.

In FIG. 16, an electric current flows through a signal line 200 in a direction, perpendicular to the plane of paper. The metallic wire 600 is placed under the signal line 200 so that the central axis of the metallic wire 600 is parallel to the electric field, as in the case of the first embodiment. In addition, the lower surface in FIG. 16 is a ground 220.

Since the metallic wire 600 has ends in a nearly linear shape, the resonating wavelength is longer, and the resonant frequency is this lower, as compared with the metallic body in the shape of a spring at a uniform pitch as described in the first to third embodiments.

Figure 17:
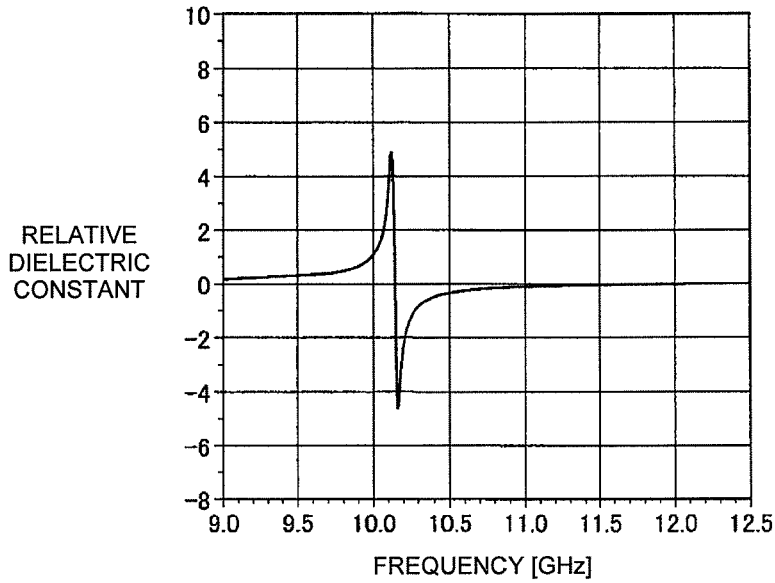
FIG. 17 is a diagram showing the relative dielectric constant of the metallic wire shown in FIG. 16.

FIG. 17 shows the relative dielectric constant of the metallic wire 600 in FIG. 16. It is determined from FIG. 17 that the metallic wire 600 has a negative dielectric constant around 10.2 GHz.

Figure 18:
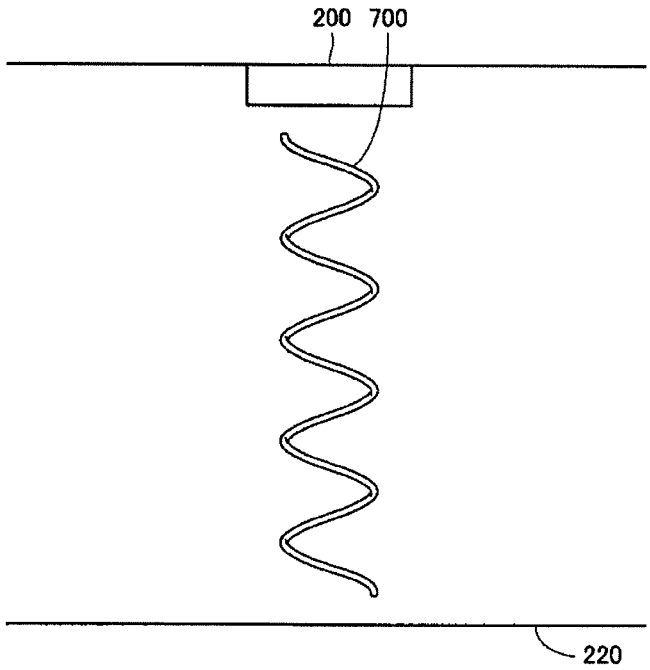
FIG. 18 is a diagram illustrating a metamaterial using a metallic wire which has the same length as that of the metallic wire shown in FIG. 16 and has a uniform pitch.
Figure 19:
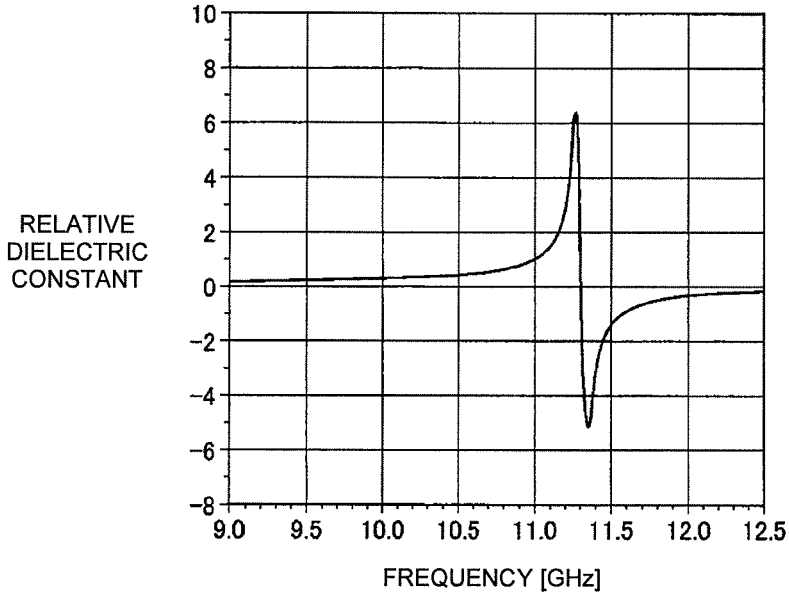
FIG. 19 is a diagram showing the relative dielectric constant of the metallic wire shown in FIG. 18.

For comparison, a metallic wire 700 will be described which has the same length (15 mm) as that of the metallic wire 600 and is coiled in the shape of a spring at a uniform pitch. When the metallic wire 700 is placed as shown in FIG. 18, the metallic sire 700 exhibits a relative dielectric constant as shown in FIG. 19. As can be seen from FIG. 19, the metallic wire 700 exhibits a negative dielectric constant around 11.4 GHz.

When the results in FIGS. 17 and 19 are compared with each other, it is determined that the metallic wire 600 has a smaller resonant frequency as compared with the metallic wire 700. According to this result, when a resonant frequency is to be obtained, the use of a metallic body coiled more near the center with its ends in a nearly linear shape, rather than a metallic body at a uniform pitch, allows the entire size of the metamaterial to be reduced.

An example of changing the metallic wire 100 according to the first embodiment in shape has been described here. However, it will be understood that the metallic wire 100 in the second embodiment or the third embodiment may be changed in shape in the same way.

Sixth Embodiment

Figure 20:
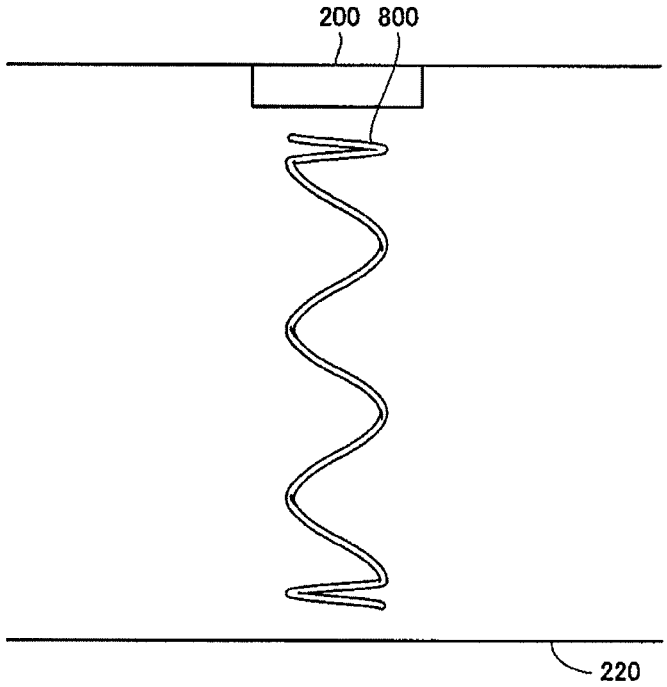
FIG. 20 is a diagram for explaining the configuration of a metamaterial according to a sixth embodiment.

In the sixth embodiment, in contrast to the fifth embodiment, a metallic wire 800 coiled in the shape of a spring is used which has a smaller pitch at either end thereof than in a central portion thereof. FIG. 20 shows the configuration of a metamaterial according to the sixth embodiment. The total length of the metallic wire 800 is 15 mm as in the case of the metallic wire 600 and the metallic wire 700.

In the sixth embodiment, the coiled section of the metallic wire 700 is concentrated on points at the highest potential and the lowest potential, thus resulting in an increase in electric field strength and in larger variations in relative dielectric constant.

Figure 21:
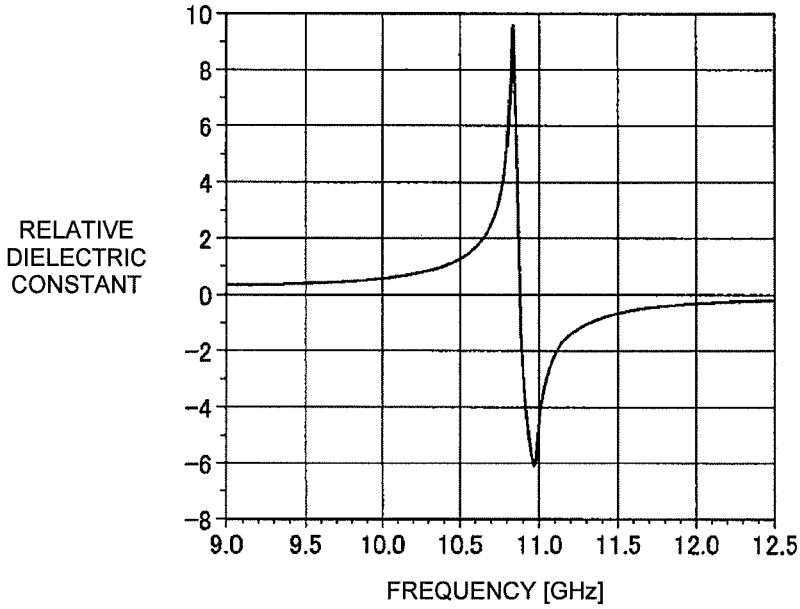
FIG. 21 is a diagram showing the relative dielectric constant of the metallic wire shown in FIG. 20.

FIG. 21 shows the relative dielectric constant of the metallic wire 800 in FIG. 20. It is determined that the variation of the relative dielectric constant is larger as compared with FIG. 19. In addition, it is determined that a negative dielectric constant is achieved over a wide band range. Further, the smaller pitch at either end increases the electric field strength at either end, and decreases the resonant frequency as compared with the metallic wire 700 shown in FIG. 18.

An example of changing the metallic wire 100 according to the first embodiment in shape has been described here. However, it will be understood that the metallic wire 100 in the second embodiment or the third embodiment may be changed in shape in the same way.

Seventh Embodiment

Figure 22:
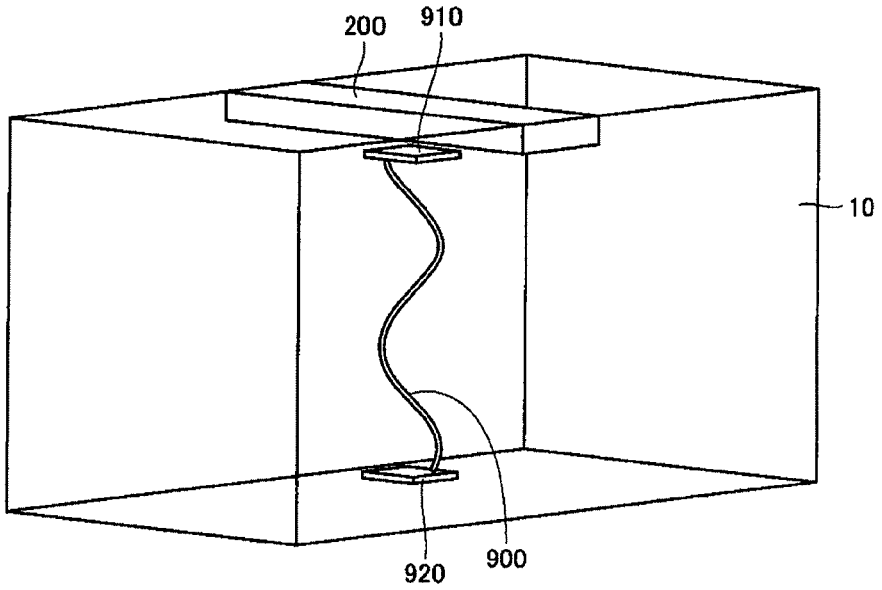
FIG. 22 is a diagram for explaining the configuration of a metamaterial according to a seventh embodiment.

A metamaterial according to the seventh embodiment is shown in FIG. 22. FIG. 22 is a diagram for explaining the configuration of a metamaterial according to the seventh embodiment.

As shown in FIG. 22, the metamaterial according to the seventh embodiment includes a metallic wire 900 coiled in the shape of a spring, and plate electrodes 910, 920. The plate electrodes 910, 920 are connected respectively to different ends of the metallic wire 900.

The metamaterial according to the present embodiment decreases the resonant frequency, because the plate electrodes 910, 920 add a capacitance to the both ends of the metallic wire 900. This decrease means that the length of the metallic wire required for obtaining a resonant frequency may be short. Therefore, as compared with a type of metamaterial including no plate electrode, the metamaterial can be further reduced in size. In addition, the metamaterial according to the present embodiment can achieve a negative dielectric constant with a larger absolute value. This is because the coil may be short, and as a result, the loss due to the electrode is reduced to increase Q.

Figure 23:
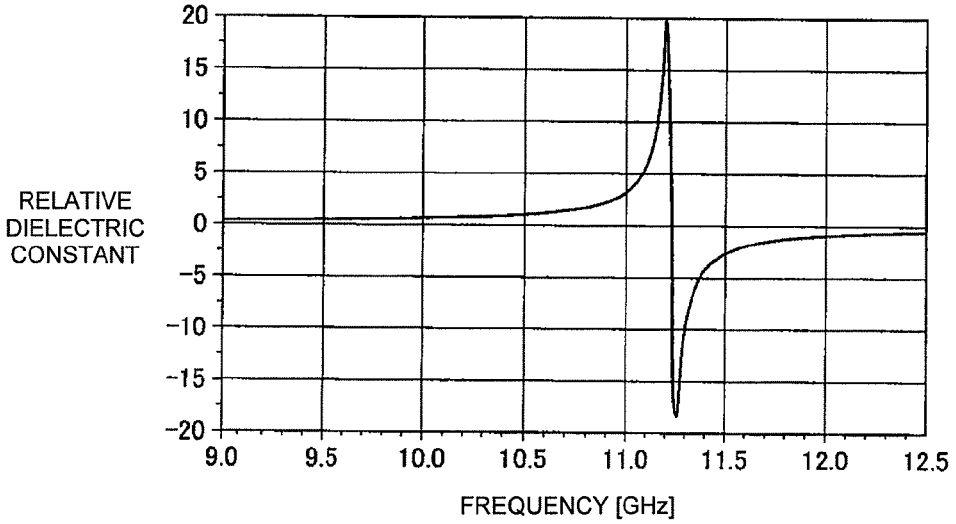
FIG. 23 is a diagram showing the relative dielectric constant of the metamaterial shown in FIG. 22.
Figure 24:
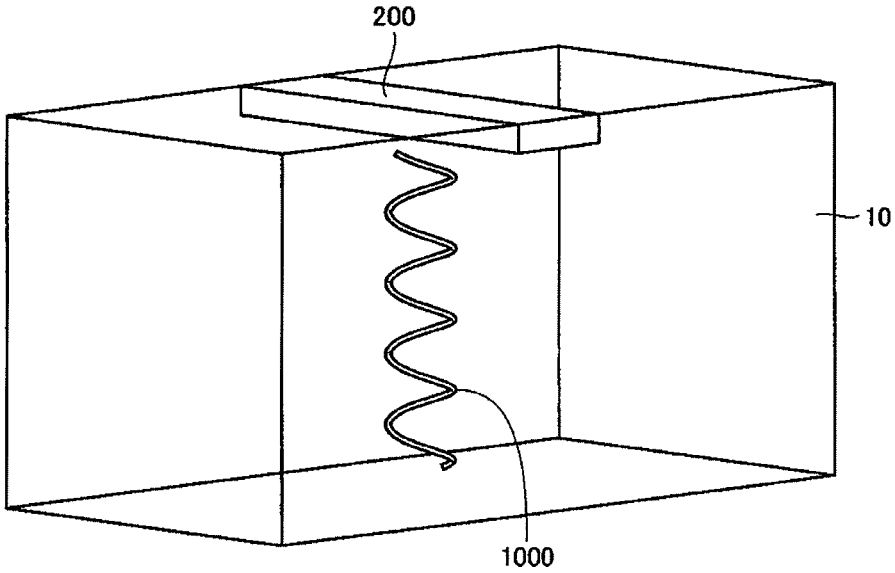
FIG. 24 is a diagram illustrating a metamaterial which has the same resonant frequency as that of the metamaterial shown in FIG. 22.
Figure 25:
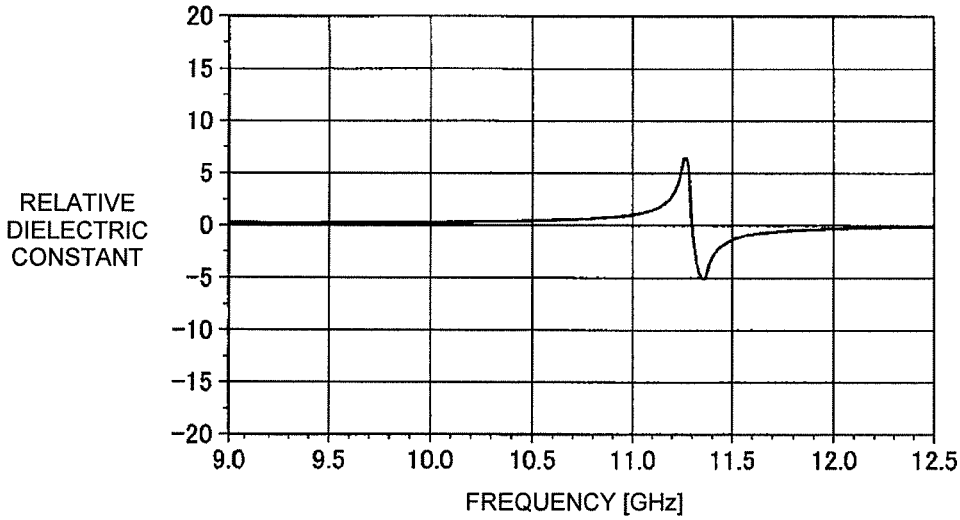
FIG. 25 is a diagram showing the relative dielectric constant of the metamaterial shown in FIG. 24.

This increase in Q will be described with reference to FIGS. 23 to 25. FIG. 23 is a diagram showing the relative dielectric constant of the metamaterial in FIG. 22, in which a negative dielectric constant is generated between 11.2 GHz and 11.3 GHz. On the other hand, FIG. 24 is a diagram illustrating a metamaterial including a metallic wire 1000 with no plate electrode, which has the same resonant frequency as that for the metamaterial in FIG. 22. In addition, FIG. 25 is a diagram showing the relative dielectric constant of the metamaterial shown in FIG. 24. When FIG. 23 is compared with FIG. 25, it is determined that the metamaterial according to the present embodiment takes a larger value for the absolute value of the negative dielectric constant.

It is to be noted that the metamaterial with the plate electrode at the both ends of the metallic wire is shown in FIG. 22. However, a configuration may be employed which has a plate electrode only at one end of a metallic wire, although the effect of decrease in resonant frequency is decreased.

Eighth Embodiment

Figure 26:
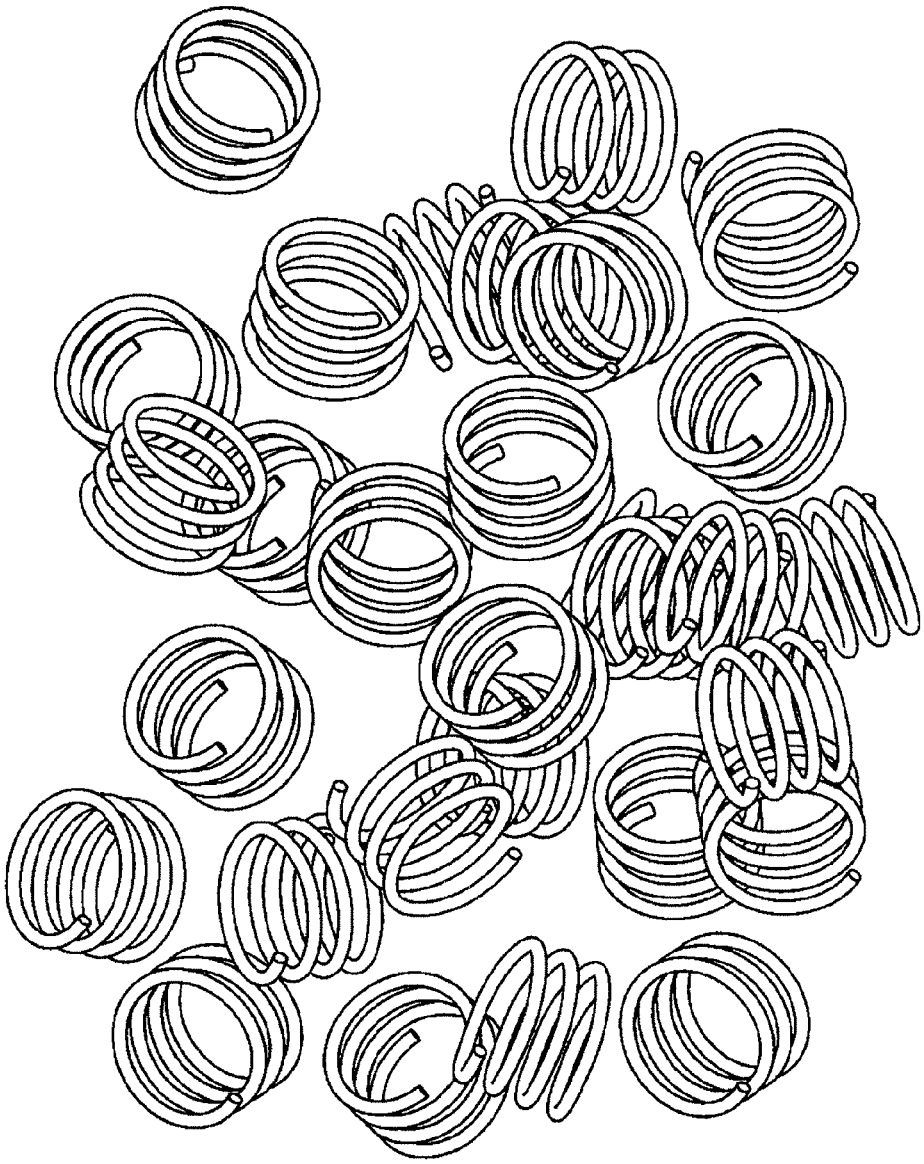
FIG. 26 is a conceptual diagram for a metamaterial according to an eighth embodiment.

As described in the first to third embodiments, the metallic wire in the shape of a spring develops one both of a negative dielectric constant and a negative magnetic permeability, depending on the direction of the central axis of the metallic wire. This development indicates that a left-handed metamaterial can be achieved by dispersing metallic wires in the shape of a spring in a medium in a random manner. FIG. 26 is a conceptual diagram for a metamaterial according to the eighth embodiment.

Conventional metamaterials have limitations in the orientations of the components constituting the metamaterials, such as the need for a metal rod placed parallel to an electric field and for a resonator placed parallel to a magnetic field. This is because the placement of the metal rod and resonator respectively perpendicular to the electric field and the magnetic field fails to give rise to a resonance, and thus fails to develop a negative dielectric constant or magnetic permeability.

In contrast, the metallic wire in the shape of a spring has, in any orientation, a negative dielectric constant or a negative magnetic permeability (both depending on the angle) with respect to an electric field and a magnetic field. Therefore, a left-handed metamaterial can be achieved by dispersing the metallic wire in a medium in a random manner. This metamaterial can be manufactured industrially in accordance with a more inexpensive method than the arrangement of the metal rod and resonator. In addition, this metamaterial has no orientation. More specifically, the metamaterial has the property of exhibiting a negative dielectric constant and a negative magnetic permeability with respect to an electromagnetic field in any direction.

Figure 27:
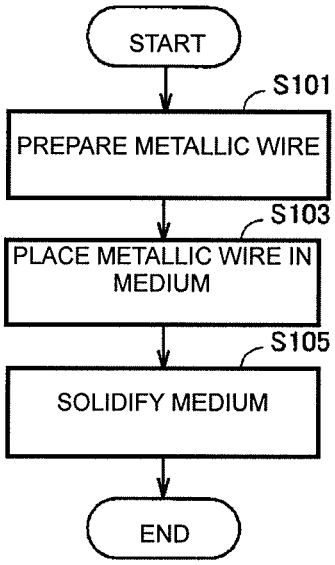
FIG. 27 is a diagram showing a method for manufacturing a metamaterial according to an eighth embodiment in the form of a flowchart.

A method for manufacturing a metamaterial according to the present embodiment will be described with reference to FIG. 27. FIG. 27 is a diagram showing a method for manufacturing a metamaterial according to the eighth embodiment in the form of a flowchart.

In step S101, a plurality of metallic wires 100 is prepared. Each metallic wire 100 is coiled in the shape of a spring as in the case of the respective embodiments already described, and has a length of substantially ½ a resonant wavelength.

In step S103, the plurality of metallic wire 100 is placed in a fluid medium in a random manner. Specifically, for example, a frame is filled with a medium, and the plurality of metallic wires 100 is put into the medium. Alternatively, the plurality of metallic wires 100 may be placed in a frame in a random manner, and a medium may be then poured. As the medium, for example, an epoxy resin, etc, are used.

In step S105, the medium is solidified. For example, heat is applied to solidify the medium.

It is to be noted that it is preferable to use a metallic wire 100 with an insulating film as the metallic wires 100. Even when the metallic wire 100 with the insulating film is brought into contact with the other metallic wires 100 in the medium, the wire rods in the insulating film will not come in contact with each other, and the metallic wire 100 thus exhibits a negative dielectric constant or magnetic permeability. In addition, the use of the spherical metallic wire described in the fourth embodiment as the metallic wires 100 facilitates industrialization.

[Conductor Line]

Next, the use of a printing method or the like for forming the metallic wire 100 will be described.

Figure 28:
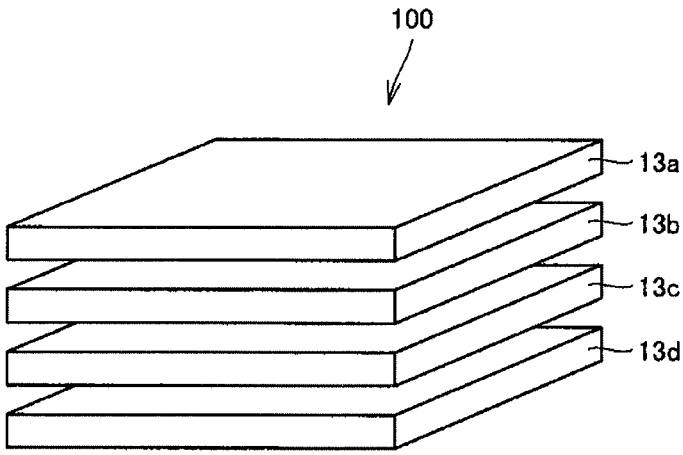
FIG. 28 is an external view of a metamaterial including a metallic wire formed with the use of a printing method.
Figure 29:
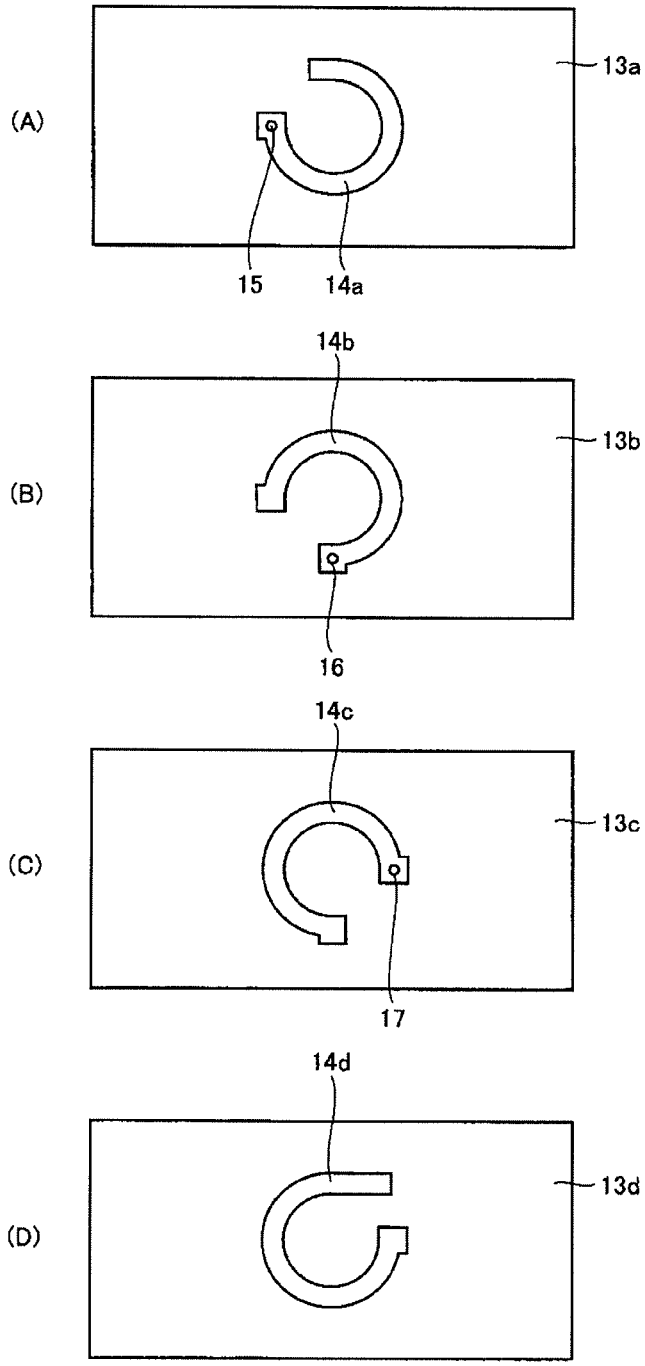
FIG. 29 is a diagram for explaining the structure of the metamaterial shown in FIG. 28.

FIG. 28 is an external view of a metamaterial including a metallic wire 100 formed with the use of a printing method. FIG. 29 is a diagram for explaining the structure of the metamaterial shown in FIG. 28.

Referring to FIG. 28, the metamaterial obtained with the use of the printing method includes multiple insulating sheets 13*a* to 13*d*. These sheets 13*a* to 13*d* preferably have a dielectric property. It is to be noted that while the metamaterial which has a four-layer structure is shown as an example in FIG. 28, the number of layers stacked is appropriately designed depending on the size and the application. The surfaces of these stacked sheets each have a conductor line formed, and these conductor lines are electrically connected three-dimensionally to form a coil as a whole More specifically, the surfaces of the sheets 13*a* to 13*d* respectively have metallic conductor lines formed by printing or the like as shown in FIGS. 29(A) to 29(D). In other words, the surfaces of the sheets 13*a* to 13*d* respectively have conductor lines 14*a* to 14*d* formed in the shape of arc. The conductor lines 14*a* to 14*d* are connected sequentially so as to form a series of coil, by sequentially stacking the sheets 13*a* to 13*d*. Therefore, one end of the conductor line 14*a* has a via hole 15 for connecting the end to one end of the adjacent conductor like 14*b* (FIG. 29(A)). Likewise, the other end of the conductor line 14*b* has a via hole 16 for connecting the end to one end of the adjacent conductor line 14*c* (FIG. 29(B)). Furthermore, the other end of the conductor line 14*a* has a via hole 17 formed for connecting the end to one end of the adjacent conductor line 14*d* (FIG. 29(C)).

When this configuration is adopted, the conductor lines 14*a* to 14*d* are electrically connected sequentially by stacking the sheets 13*a* to 13*d*, thereby forming a coil with a central axis extending in the thickness direction of the stack.

[Others]

In the case of the metallic wire with open ends as described previously, the metallic wire resonates with an electromagnetic wave when the metallic wire has a length around an odd multiple of the wavelength $\lambda/2$ of the electromagnetic wave. Accordingly, even when a metallic wire is used which is three or five times as long as the wavelength $\lambda/2$, the metallic wire functions as a metamaterial. However, the use of a metallic wire which has a length of substantially $\lambda/2$ is preferable for the reduction in size.

Alternatively, in the case of a metallic wire with one side connected to a ground or a signal line, the metallic wire resonates with an electromagnetic wave when the metallic wire has a length around an integral multiple of $\lambda/4$. This case has the advantage that the metallic wire may be short. On the other hand, the metallic wire has to be connected to the signal line and/or GND, which is disadvantageous for versatility as an artificial material. In terms of versatility, the structure with either end of the metallic wire unconnected to the signal line and/or GND is preferable as described above.

The embodiments disclosed herein are to be considered exemplary in all respects, but not to be considered restrictive. The scope of the present invention is defined by the claims, not by the description above, and intended to encompass all modifications within the spirit and scope equivalent to the claims.

DESCRIPTION OF REFERENCE SYMBOLS

10 outer covering
100 metallic wire
110 central axis
200 signal line
220 ground
300 metallic wire
410 positive charge
420 negative charge
430 negative charge region
440 positive charge region
500 metallic wire
600 metallic wire
700 metallic wire
800 metallic wire
900 metallic wire
910, 920 plate electrode
1000 metallic wire

The invention claimed is:

1. A metamaterial which exhibits a negative dielectric constant at a predetermined wavelength, the metamaterial comprising:

a metallic wire in the shape of a spring, the metallic wire having a length of substantially half the predetermined wavelength;

a conductor through which an electric current flows;

a ground serving as a reference potential; and a supporting member between the conductor and the ground for fixing a position of the metallic wire so that a central axis of the metallic wire is parallel to a direction of an electric field between the conductor and the ground.

2. The metamaterial according to claim 1, wherein the metallic wire has an insulating film.

3. The metamaterial according to claim 1, wherein the metallic wire is coiled so as to follow a spherical surface.

4. The metamaterial according to claim 1, wherein the metallic wire has a smaller pitch at either end thereof than in a central portion thereof.

5. The metamaterial according to claim 1, wherein the metallic wire has a larger pitch at either end thereof than in a central portion thereof.

6. The metamaterial according to claim 1, further comprising a conductive plate connected to an end of the metallic wire.

7. A metamaterial which exhibits a negative dielectric constant at a predetermined wavelength, the metamaterial comprising:

a plurality of metallic wires in the shape of a spring, each of the metallic wires having a length of substantially half the predetermined wavelength;

a conductor through which an electric current flows;

a ground serving as a reference potential; and a supporting member between the conductor and the ground for fixing positions of the plurality of metallic wires so that a central axis of each of the metallic wires is parallel to a direction of an electric field between the conductor and the ground.

8. The metamaterial according to claim 7, wherein the supporting member fixes the plurality of metallic wires in irregular directions.

9. The metamaterial according to claim 8, wherein each of the metallic wires has an insulating film.

10. The metamaterial according to claim 7, wherein the metallic wire is coiled so as to follow a spherical surface.

11. The metamaterial according to claim 7, wherein the metallic wire has a smaller pitch at either end thereof than in a central portion thereof.

12. The metamaterial according to claim 7, wherein the metallic wire has a larger pitch at either end thereof than in a central portion thereof.

13. The metamaterial according to claim 7, further comprising a conductive plate connected to an end of the metallic wire.

14. A metamaterial which exhibits a negative magnetic permeability at a predetermined wavelength, the metamaterial comprising:

a metallic wire in the shape of a spring, the metallic wire having a length of substantially half the predetermined wavelength; and a supporting member fixing a position of the metallic wire so that a central axis of the metallic wire is parallel to a direction of a magnetic field around the metallic wire.

15. The metamaterial according to claim 14, wherein the metallic wire has an insulating film.

16. The metamaterial according to claim 14, wherein the metallic wire is coiled so as to follow a spherical surface.

17. The metamaterial according to claim 14, wherein the metallic wire has a smaller pitch at either end thereof than in a central portion thereof.

18. The metamaterial according to claim 14, wherein the metallic wire has a larger pitch at either end thereof than in a central portion thereof.

19. The metamaterial according to claim 14, further comprising a conductive plate connected to an end of the metallic wire.

20. A metamaterial which exhibits a negative magnetic permeability at a predetermined wavelength, the metamaterial comprising:

a metallic wire in the shape of a spring, the metallic wire having a length of substantially half the predetermined wavelength;

a conductor through which an electric current flows;

a ground serving as a reference potential; and a supporting member between the conductor and the ground for fixing a position of the metallic wire so that a central axis of the metallic wire is parallel to a direction of a magnetic field generated by the electric current.

21. The metamaterial according to claim 20, wherein each of the metallic wires has an insulating film.

22. The metamaterial according to claim 20, wherein the metallic wire is coiled so as to follow a spherical surface.

23. The metamaterial according to claim 20, wherein the metallic wire has a smaller pitch at either end thereof than in a central portion thereof.

24. The metamaterial according to claim 20, wherein the metallic wire has a larger pitch at either end thereof than in a central portion thereof.

25. The metamaterial according to claim 20, further comprising a conductive plate connected to an end of the metallic wire.

26. A metamaterial which exhibits a negative magnetic permeability at a predetermined wavelength, the metamaterial comprising:

a plurality of metallic wires in the shape of a spring, each of the metallic wires having a length of substantially half the predetermined wavelength;

a conductor through which an electric current flows;

a ground serving as a reference potential; and a supporting member between the conductor and the ground for fixing positions of the plurality of metallic wires so that a central axis of each of the metallic wires is parallel to a direction of a magnetic field generated by the electric current.

27. The metamaterial according to claim 26, wherein the supporting member fixes the plurality of metallic wires in irregular directions.

28. The metamaterial according to claim 27, wherein each of the metallic wires has an insulating film.

29. The metamaterial according to claim 26, wherein the metallic wire is coiled so as to follow a spherical surface.

30. The metamaterial according to claim 26, wherein the metallic wire has a smaller pitch at either end thereof than in a central portion thereof.

31. The metamaterial according to claim 26, wherein the metallic wire has a larger pitch at either end thereof than in a central portion thereof.

32. The metamaterial according to claim 26, further comprising a conductive plate connected to an end of the metallic wire.

33. A metamaterial which exhibits a negative dielectric constant and a negative magnetic permeability at a predetermined wavelength, the metamaterial comprising:

a metallic wire in the shape of a spring, the metallic wire having a length of substantially half the predetermined wavelength;

a conductor through which an electric current flows;

a ground serving as a reference potential; and a supporting member between the conductor and the ground for fixing a position of the metallic wire so that a central axis direction of the metallic wire is nonorthogonal to a direction of an electric field generated by the electric current and a direction of the central axis is nonorthogonal to a direction of a magnetic field generated by the electric current.

34. The metamaterial according to claim 33, wherein the metallic wire has an insulating film.

35. The metamaterial according to claim 33, wherein the metallic wire is coiled so as to follow a spherical surface.

36. The metamaterial according to claim 33, wherein the metallic wire has a smaller pitch at either end thereof than in a central portion thereof.

37. The metamaterial according to claim 33, wherein the metallic wire has a larger pitch at either end thereof than in a central portion thereof.

38. The metamaterial according to claim 33, further comprising a conductive plate connected to an end of the metallic wire.

39. A metamaterial which exhibits a negative dielectric constant and a negative magnetic permeability at a predetermined wavelength, the metamaterial comprising:

a plurality of metallic wires in the shape of a spring, each of the metallic wires having a length of substantially half the predetermined wavelength;

a conductor through which an electric current flows;

a ground serving as a reference potential; and a supporting member between the conductor and the ground for fixing positions of the plurality of metallic wires so that a central axis direction of each of the metallic wires is nonorthogonal to a direction of an electric field generated by the electric current and nonorthogonal to a direction of a magnetic field generated by the electric current.

40. The metamaterial according to claim 39, wherein the supporting member fixes the plurality of metallic wires in irregular directions.

41. The metamaterial according to claim 40, wherein each of the metallic wires has an insulating film.

42. The metamaterial according to claim 39, wherein the metallic wire is coiled so as to follow a spherical surface.

43. The metamaterial according to claim 39, wherein the metallic wire has a smaller pitch at either end thereof than in a central portion thereof.

44. The metamaterial according to claim 39, wherein the metallic wire has a larger pitch at either end thereof than in a central portion thereof.

45. The metamaterial according to claim 39, further comprising a conductive plate connected to an end of the metallic wire.

* * * * *